US006823201B2

(12) United States Patent
Kai et al.

(10) Patent No.: US 6,823,201 B2
(45) Date of Patent: Nov. 23, 2004

(54) SUPERCONDUCTING MICROSTRIP FILTER HAVING CURRENT DENSITY REDUCTION PARTS

(75) Inventors: Manabu Kai, Kawasaki (JP); Toru Maniwa, Kawasaki (JP); Kazunori Yamanaka, Kawasaki (JP); Akihiko Akasegawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/207,620

(22) Filed: Jul. 26, 2002

(65) Prior Publication Data

US 2003/0016094 A1 Jan. 23, 2003

Related U.S. Application Data

(63) Continuation of application No. PCT/JP00/00491, filed on Jan. 28, 2000.

(51) Int. Cl.[7] ..... H01P 1/203; H01B 12/02

(52) U.S. Cl. ..... 505/210; 505/701; 505/866; 333/99 S; 333/204

(58) Field of Search ..... 333/995, 204, 333/219; 505/210, 700, 701, 866

(56) References Cited

U.S. PATENT DOCUMENTS 3,451,015 A * 6/1969 Heath ..... 333/203
4,371,853 A * 2/1983 Makimoto et al. ..... 333/204
5,219,827 A * 6/1993 Higaki et al. ..... 333/219 X
6,041,245 A * 3/2000 Mansour ..... 333/99 S X

FOREIGN PATENT DOCUMENTS

| | | | |
|---|---|---|---|
| EP | 0 720 248 A2 | 7/1996 | |
| EP | 0 720 248 A3 | 8/1996 | |
| EP | 0 917 236 | 5/1999 | |
| JP | 6204702 * | 7/1994 | ..... 333/204 |
| WO | 99/00897 | 1/1999 | |

* cited by examiner

*Primary Examiner*—Benny T. Lee
(74) *Attorney, Agent, or Firm*—Katten Muchin Zavis Rosenman

(57) ABSTRACT

A superconducting microstrip filter capable of achieving an improvement of power resistance without enlarging the overall size and while maintaining steep cut characteristics. This filter has a resonator section including at least one resonator. This resonator forms a current density reduction part in one part of its line pattern. Also, the filter has an input line section arranged adjoining the resonator of an initial stage. Current density reduction parts are formed in one part of this input line section. Alternatively, the input line section is comprised of a normal conductor.

10 Claims, 16 Drawing Sheets

14

14

SUPERCONDUCTING MICROSTRIP FILTER HAVING CURRENT DENSITY REDUCTION PARTS

CROSS-REFERENCE TO RELATED APPLICATION

This application is a continuation application and is based upon PCT/JP00/00491, filed on Jan. 28, 2000.

TECHNICAL FIELD

The present invention relates to a superconducting microstrip filter comprised of superconducting microstrip lines, for example a superconducting microstrip filter preferred when used for a receiver apparatus of a base station in a mobile communication system.

According to the above example, an input stage of a receiver apparatus of a base station requires as one essential component a filter for passing only signals of frequency bands required for communication. In this case, a filter exhibiting so-called steep cut characteristics is needed in order to make it possible to sufficiently accommodate the rapid increase in the number of mobile communications users, that is subscribers, of recent years at the base station. This is because, the steeper the cut characteristics, the more possible it becomes to use predetermined frequency bands to increase the number of accommodated subscribers.

As a filter capable of obtaining such steep cut characteristics, a filter configured by a plurality of resonators that are cascaded in multiple stages is being employed at present. The larger the number of stages of these resonators, the steeper are the cut characteristics.

On the other hand, however, the inconvenience occurs that the larger the number of cascaded stages of the resonators, the larger an insertion loss in the pass band of the filter.

In order to avoid such an inconvenience, usage of a filter comprised of a superconducting material in place of filters comprised of non-superconducting metal which have been conventionally generally used has been proposed in recent years. Research and development have been underway for commercialization of such a filter. This is a superconducting microstrip filter. Since a surface resistance of a superconducting material is smaller than the surface resistance of non-superconducting metal by two to three orders, an extremely low insertion loss can be realized in the pass band while maintaining the steep cut characteristics. The present invention covers such a superconducting microstrip filter. Note that, below, this will also be simply referred to as a superconducting filter.

BACKGROUND ART

The base station based on the above example must receive a further higher power at the receiver apparatus along with the increase of the number of subscribers in recent years. Also, this receiver apparatus is connected to a duplex antenna, so inevitably receives wraparound power due to its own strong transmission power. Furthermore, this base station is provided with a few duplex antennas in proximity to each other, so also receives strong transmission power from adjacent channels.

Under such a circumstance, a higher power resistance is required for the filter in the receiver apparatus. Namely, a high enough power the power resistance must be sufficiently high for the cut characteristics of the filter to be maintained without deterioration even if high power applications of the filter are required.

However, there is a deficiency in that the power resistance is remarkably inferior in the case of a superconducting filter in comparison with a general filter made of ordinary metal. This deficiency is derived from a critical temperature ($T_c$) inherent in the superconducting filter and a critical current density ($J_e$) inherent in the superconducting filter. Among them, particularly the critical current density ($J_e$) has an extremely close relationship with realization of the function of the superconducting filter.

Accordingly, an improvement of the power resistance must be achieved while keeping the current density below the critical current density ($J_c$). Note that, it is also essential to maintain the temperature below the critical temperature ($T_c$), but this depends upon the capacity of an external cooling machine, and is not particularly referred to in the present invention.

As will be explained in detail below by using the drawings, as a known superconducting filter improved in the power resistance, for example, the filter disclosed in the document "High-Power HTS Microstrip Filters for Wireless Communications", Guo-Chun Liang etc., IEEE Trans. On MTT, vol. 43, No. 12, Dec. 1995, is already known. In each resonator comprising this filter, the line width is enlarged by reducing the characteristic impedance of the line and concentration of current is suppressed. Specifically this is a filter wherein the line width over the entire length of the lines of the resonators is increased by reducing the characteristic impedance of the resonator to 10 Ω though the characteristic impedance of an input/output line section of that filter is set at 50 Ω.

However, when trying to suppress the current concentration, that is, the reduction of the current density, according to the above conventional example, since the line width is enlarged over the entire length of the lines forming the resonators by merely lowering the characteristic impedance of the lines, there is a problem that the filter formed by arranging these resonators in a line ends up becoming unavoidably large.

When applying the above prior art to a superconducting filter configured of a plurality of resonators obtained by bending λ/2 resonators in a hair pin shape arranged in a line, being widely employed in recent years for the improvement of the power resistance, the superconducting filter becomes considerably large in size. If forming that superconducting filter on an inexpensive leading substrate (MgO, etc.) having a diameter of about 5 cm, just placing five resonators on that substrate becomes a handful. The problem then is that the intended steep cut characteristics can no longer be obtained.

In consideration of the above problems, an object of the present invention is to provide a superconducting microstrip filter capable of achieving an improvement of the power resistance while making it possible to maintain a current density below the critical current density ($J_c$) without making the overall filter large in size.

In further detail, another object of the present invention is to provide a configuration effective as a filter for reception waves and a configuration effective as a filter for transmission waves. Here, according to the above example, a "filter for reception waves" means a filter effective particularly with respect to the input power received by the receiver apparatus of the base station from the subscriber side, while a "filter for transmission waves" means a filter effective particularly with respect to the wraparound power due to the transmission power output by a transmitter apparatus paired with that receiver apparatus at a close distance at that base station or with respect to the transmission power directly received from another antenna of that base station. Note that the frequency band is different between the reception waves and the transmission waves.

Still another object of the present invention is to provide a superconducting filter which can be applied as a filter for reception waves, as a filter for transmission waves, or as a filter for both of the reception waves and transmission waves.

To attain the above objects, the present invention proposes the following first to fifth aspects:

A first aspect is a superconducting microstrip filter having a resonator section including at least one resonator, wherein the resonator forms a current density reduction part in one part of a line pattern thereof. This is a filter for reception waves.

A second aspect is a superconducting microstrip filter having a resonator section including a plurality of resonators cascaded in a line along a propagation path of signals to be filtered, wherein at least the resonators cascaded at the center portion of the propagation path and in the vicinity thereof form current density reduction parts in parts of the line patterns thereof and form the current density reduction parts larger in the resonators nearer the center portion. This is also a filter for reception waves.

A third aspect is a superconducting microstrip filter having a resonator section including a plurality of resonators cascaded in a line along a propagation path of signals to be filtered, wherein at least resonators cascaded at the center portion of the propagation path and in the vicinity thereof form current density reduction parts over the entire lengths of the line patterns thereof and form the current density reduction parts larger in the resonators nearer the center portion. This is also a filter for reception waves.

A fourth aspect is a superconducting microstrip filter having an input line section to which signals to be filtered are input and a resonator section arranged adjoining this input line section and including at least one resonator, wherein that input line section forms a current density reduction part in one part of its line pattern. This is a filter for transmission waves.

A fifth aspect is a superconducting microstrip filter having an input line section to which signals to be filtered are input and a resonator section arranged adjoining this input line section and including at least one resonator, wherein only that input line section is formed by a line pattern made of a material other than a superconducting material. This is also a filter for transmission waves.

The first to fifth aspects can be realized separately and independently from each other and also can be realized as a combination of some aspects. This will be clarified by the following explanation.

BEST MODE FOR CARRYING OUT THE INVENTION

In order to further facilitate understanding of the present invention, first, an explanation will be made of the general configuration.

Figure 13:
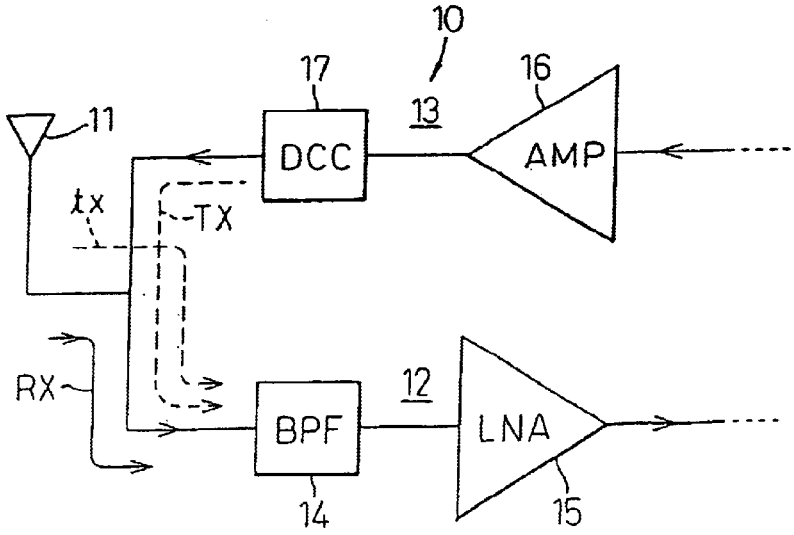
Fig. 13 PRIOR ART
FIG. 13 shows a front end section of a base station as an example to which the present invention is applied.

FIG. 13 is a view of a front end section of a base station as an example to which the present invention is applied.

In the figure, a front and section 10 is comprised of a duplex antenna 11, a receiver apparatus 12 for receiving input power from the antenna 11, and a transmitter apparatus 13 for transmitting the power from the antenna 11.

The receiver apparatus 12 is comprised including a band-pass filter (BPF) 14 for extracting only signals of intended frequency bands from among signals received from the antenna 11 and a low noise amplifier 15.

On the other hand, the transmitter apparatus 13 is comprised including a signal amplifier (AMP) 16 and a distortion compensating circuit (DCC) 17 and generates a signal to be transmitted from the antenna 11.

In the front end section 10, it is particularly the band-pass filter (BPF) 14 in the receiver apparatus 12 to which the present invention is applied. This filter 14 is comprised of a superconducting microstrip filter (superconducting filter).

The main function of this superconducting filter 14 is to extract a signal of the intended frequency band from among signals Rx received by a path indicated by a solid arrow from the antenna 11 (filter for reception wave).

On the other hand, this superconducting filter 14 also functions to cut a wraparound signal TX by a path indicated by a dotted arrow among the transmitted signals from the transmitter apparatus 13 side. Similarly, it also functions to cut the penetrated signal tx by the path indicated by the dotted arrow from the antenna 11 among signals transmitted from other antennas (not illustrated) of the base station (filter for transmission waves).

Below, an explanation will be made of a general superconducting filter 14 used for the main function, that is as a filter for reception waves.

Figure 14:
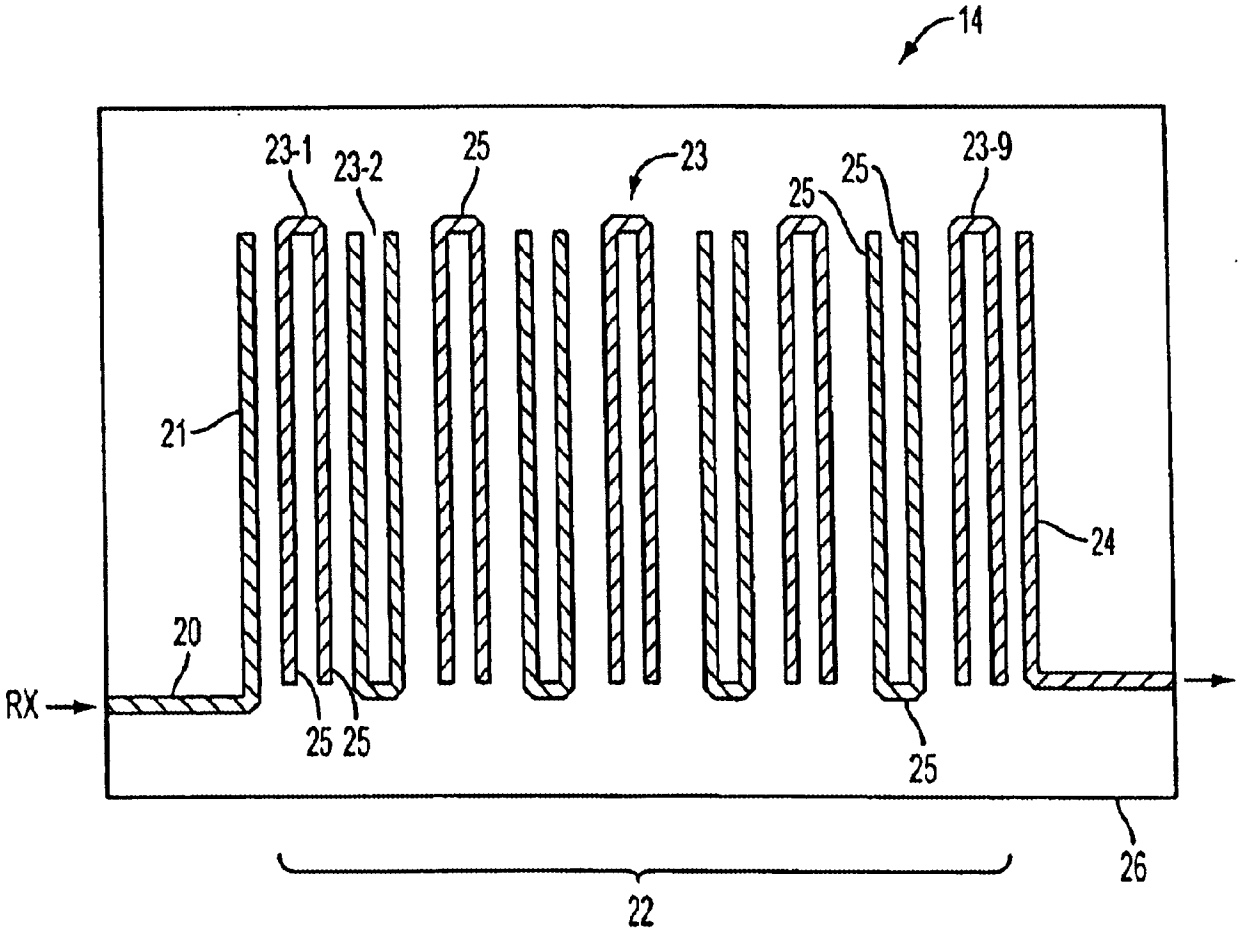
FIG. 14 PRIOR ART
FIG. 14 is a view of an example of a general superconducting microstrip filter, FIGS. 15(*a*) and 15(*b*) are views of enlarged shapes of bent portions of resonators 23 in FIG. 14 for two examples.

FIG. 14 is a view of an example of the general superconducting microstrip filter. The present invention is particularly effectively applied to a superconducting filter having a format shown in the figure.

In the figure, the superconducting filter 14 is comprised of an input conductor 20 to which the signal RX is input, and input line section 21 connected to this, a resonator section 22 for extracting only signals of intended frequency bands from among signals RN applied to this input line section 21, and an output line section 24 for transmitting the extracted signals to for example a low noise amplifier (LNA) 15. Here, the resonator section 22 is comprised including at least one resonator 23. Note, in the figure, as an example, nine stages of resonators 23-1, 23-2, . . . 23-9 are shown.

Also, in the figure, as each resonator 23, a microstrip hair pin type resonator configured of a $\lambda/2$ resonator bent in a hair pin shape is shown. Such a hair pin type resonator 23 is obtained by coating superconducting thin films YBCO (Y—Ba—Cu—O) on both surfaces of a substrate 26 made of for example magnesium oxide (MgO) or aluminum lanthanum oxide ($LaAlO_3$) first and then forming a line pattern 25 on the illustrated one surface by photolithography or the like. Note that, the other surface (not illustrated) of the substrate 26 is a ground plane.

The superconducting filter 14 provided with the thus obtained hair pin type resonators 23-1, 23-2, 23-3, 23-4, 23-5, 23-6, 23-7, 23-8 and 23-9 is advantageous in that design and fabrication are easy and, in addition, is extremely effective for reduction of size and lightening of weight, so will probably be widely employed in the future.

Figure 15A:
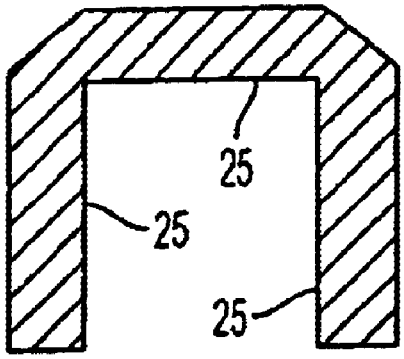
FIG. 15 A PRIOR ART
Figure 15B:
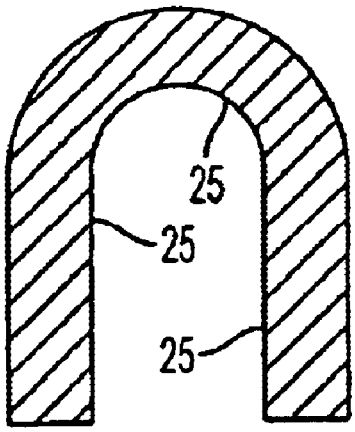
FIG. 15 B PRIOR ART

FIGS. 15(*a*) and 15(*b*) provide enlarged views of two examples of the shapes of the bent portions of the resonators 23 in FIG. 14.

FIG. 15(*a*) shows a shape where corners of the line pattern 25 are cut off and the lines bent at right angles (first example) and FIG. 15(*b*) shows a shape where the line width of the line pattern 25 of the straight line parts is held as it is and an arc state is exhibited (second example).

Note that, the superconducting filter 14 is operated by cooling the filter as a whole to an extremely low temperature such as 70K by an external cooling machine. By this, steep cut characteristics can be obtained without insertion loss.

Figure 16:
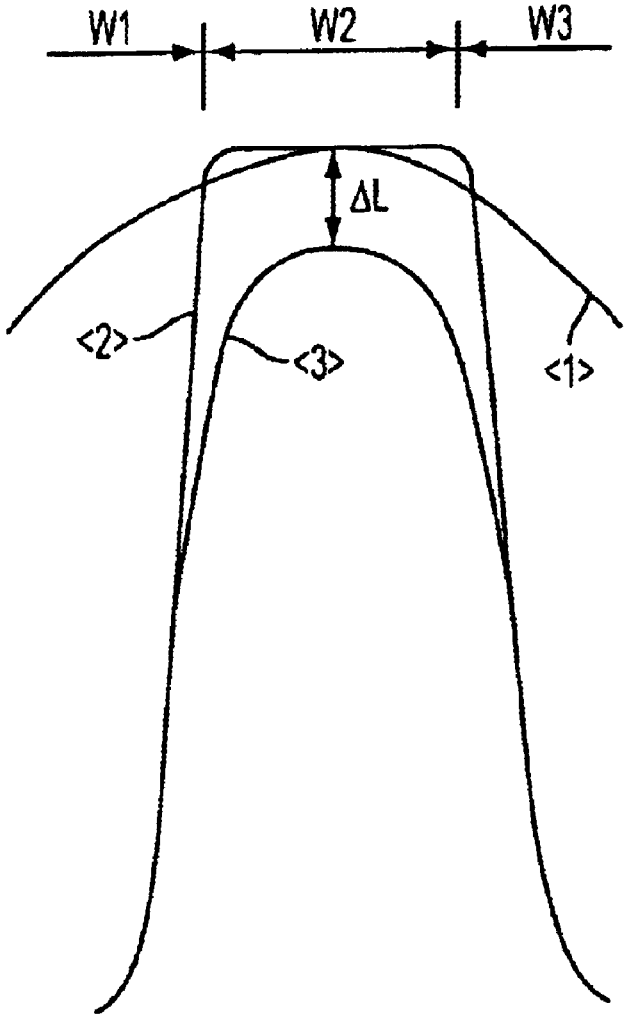
FIG. 16 PRIOR ART
FIG. 16 is a view explaining cut characteristics.

FIG. 16 is a view for explaining cut characteristics.

In the figure, both characteristics of <1>and <2>represent cut characteristics of the superconducting filter 14. On the other hand, the characteristics of <3>represent the cut characteristics by the general filter made of a non-superconducting metal. W2 in the figure indicates the pass-band, and W1 and W3 on the two ends thereof indicate cut zones.

A conspicuous difference between the characteristic <3> (filter made of ordinary metal) and the characteristics <1> and <2> (superconducting filter) resides in a difference $\Delta L$ of the insertion loss. The insertion loss of the superconducting filter is almost zero.

Note that when the number of stages of resonators 23 is decreased, as shown by the characteristic <1>, the steep cut characteristic is lost. This is the same also for the characteristic <3>.

As explained above, when realized a superconducting filter giving steep cut characteristics while keeping the insertion loss extremely low, in comparison with a general filter comprised of ordinary metal having exactly the same shape as this, the former has the defect of an inferior power resistance. It is important to overcome this defect. This will be explained in further detail.

In general, in a microstrip line, the "edge effect" of the current flowing through there being concentrated at an edge portion of that line is seen. This edge effect does not become such a large obstacle in a microstrip line made of non-superconducting metal. In a microstrip line made of a superconducting material, however, that edge effect exerts a serious influence. If the current density on the line approaches the critical current density ($J_c$), at even only one position, the superconducting characteristic thereof is lost, and the superconducting state of the entire microstrip line ends up being broken. That is, the superconducting state is broken at particularly the edge portion of the line of a line pattern comprised of a superconducting microstrip line.

A superconducting filter attempting to deal with this problem is the superconducting filter disclosed in the above document. This is shown in FIG. 17.

Figure 17:
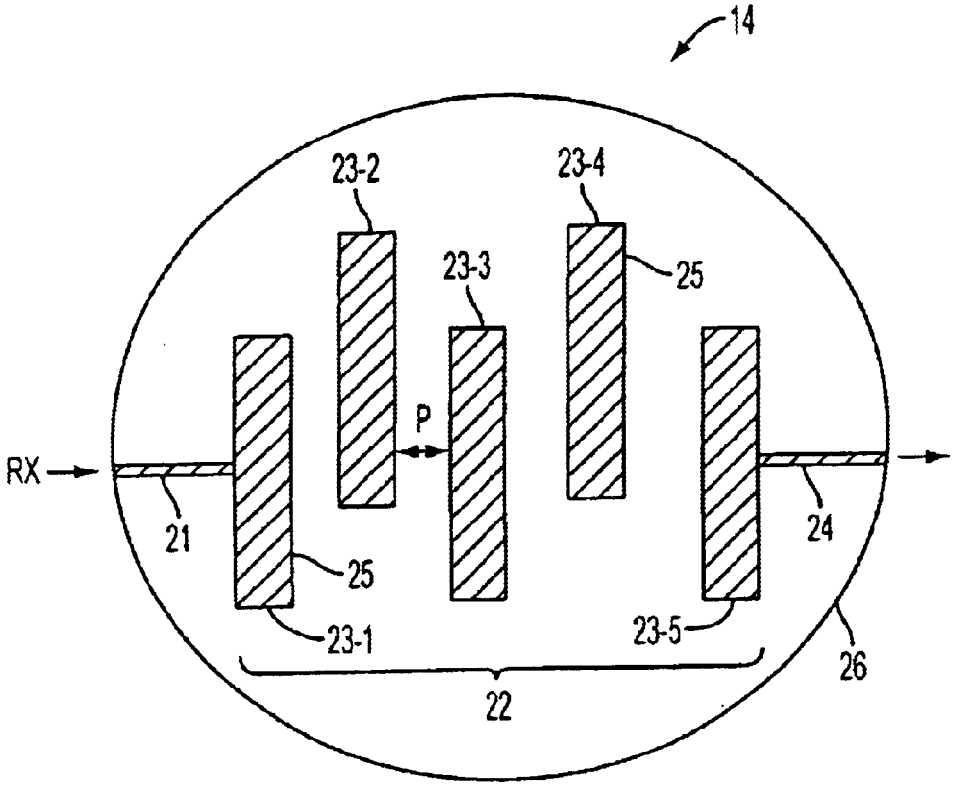
FIG. 17 PRIOR ART
FIG. 17 is a view of an example of a conventional superconducting filter suppressed in edge effect.

FIG. 17 is a view of an example of a conventional superconducting filter suppressed in the edge effect. Note that the same reference numerals or symbols are attached to similar components throughout all of the figures.

In the superconducting filter according to the conventional example shown in this figure, the input line 21, the resonator section 22 comprised of for example five stages of 23-1, 23-2, 23-3, 23-4 and 23-5, and the output line section 24 are formed on the substrate 26 by the microstrip line. In this superconducting filter, as already explained, by reducing the characteristic impedances of the resonators 23-1, 23-2, 23-3, 23-4 and 23-5, to be small, i.e., 10 Ω, although the characteristic impedances of the input line section 21 and the output line section 24 are set at 50 Ω), the line width of the line pattern 25 is expanded and a suppression of the current concentration is achieved.

For this reason, in the superconducting filter, the line width of each line pattern is formed wide over the entire length thereof (for example 3 mm). Also the pitch p between adjacent resonators has become wide. Accordingly, the superconducting filter becomes necessarily large in size, and only a few stages of resonators can be formed on an inexpensive leading substrate 26 having a diameter of about 5 cm.

In addition, when it is desired to configure the microstrip hair pin type resonator as shown in FIG. 14 by such a resonator having a wide line width, a large arc must be formed at each corner of the line pattern 25. A substrate of about 5 cm just cannot accommodate nine stages of the resonators (23-1, 23-2, 23-3, 23-4, 23-5, 23-6, 23-7, 23-8 and 23-9).

Therefore, the present invention provides the superconducting filters of the first to fifth aspects explained above.

Figure 1:
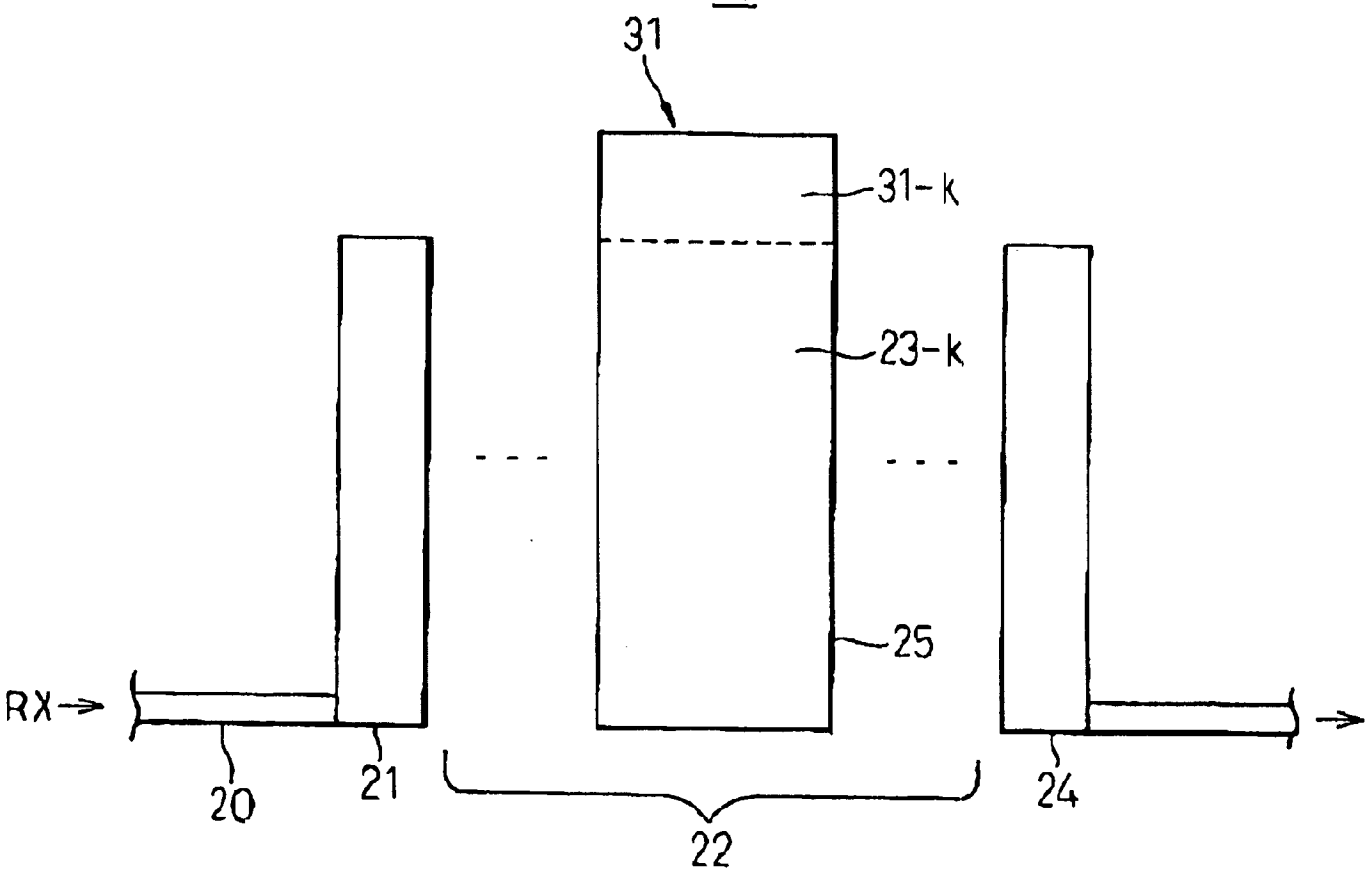
FIG. 1 is a view of the basic configuration of a superconducting filter based on a first aspect according to the present invention.

FIG. 1 is a view of the basic configuration of a superconducting filter based on the first aspect according to the present invention. The basic form is similar to the form of FIG. 14. The superconducting microstrip filter 14 is comprised on an input conductor 20 to which the signal RX is input, and input line section connected to this, a resonator section 22 for extracting only signals of intended frequency bands from among signals RX applied to this input line section 1 and an output line section 24 for transmitting the extracted signals.

This fundamental configuration is as follows: the superconducting microstrip filter 14 having a resonator section 22 including at least one resonator 23-*k* (k=1, 2, 3, . .), wherein the resonator 23-*k* forms a current density reduction part 31-*k* in one part of the line pattern thereof. Note that, in the figure, the k-th current density reduction part 31-*k* is illustrated as the current density reduction part 31.

The major difference from the configuration of FIG. 17 shown as the conventional example resides in that the current density reduction part 31 is formed by broadening the line width of only one part of the line pattern 25 of each resonator 23 in the configuration of FIG. 1 in contrast to the conventional example wherein the line width of the line pattern 25 of each resonator is broadened over the entire length thereof.

In the present invention, since the line width of only the part where the current density becomes the maximum is selectively broadened (selective formation of the current density reduction part 31), the size does not become so large when seen from the filter as a whole and rather the size can be reduced.

Accordingly, a larger number of resonators 23 having the improved power resistance can be accommodated on the substrate 26 having a limited area, and it becomes possible to keep the current density to not more than the critical current density ($J_c$) while sufficiently satisfying the steep cut characteristics explained above.

Incidentally, the idea of the present invention of forming the current density reduction part 31 for reducing the current density of only part of the resonator by paying attention to the part where the current density becomes the maximum may seen a natural idea at first glance. However, a superconducting filter achieving both an improvement of the power resistance and a reduction of size based on such a natural idea is not yet known.

The reason for this is that the belief that provision of an additional part changing the shape of the line, that is, the current density reduction part 31, in one line pattern in a general device handling super high frequency bands like microwaves would probably change the impedance of the resonator per se and the impedance between resonators, seems to be the general thinking of persons skilled in the art.

However, the present applicant found that this type of additional part does not always greatly change the impedance of the resonator per se and that between resonators. The idea of the present invention resides in this point. The present applicant found this fact by verification using electromagnetic field simulation. The results of the verification will be explained later.

Figure 2:
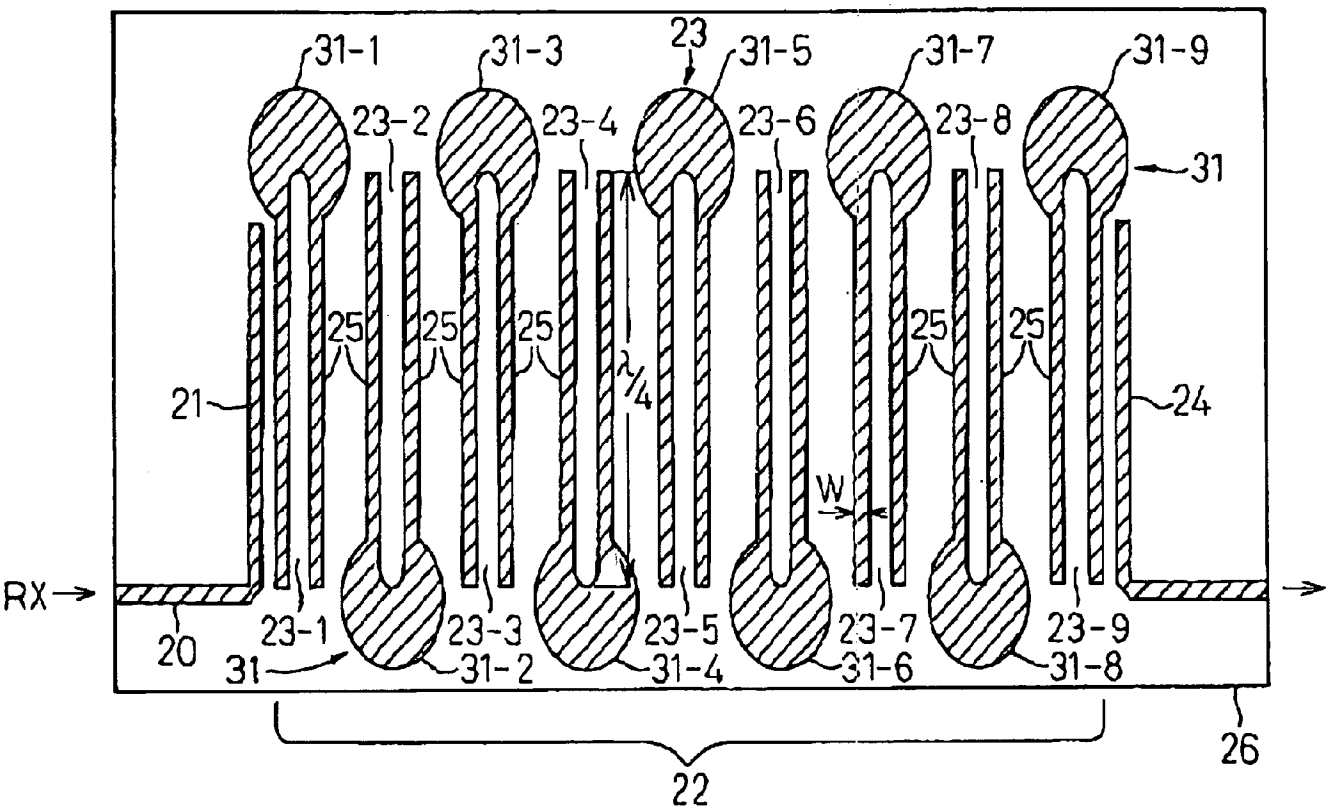
FIG. 2 is a plan view of an embodiment based on the first aspect.

FIG. 2 is a plan view of an embodiment based on the first aspect. The basic form is similar to the form of FIG. 14. The superconducting microstrip filter 14 is comprised on an input conductor 20 to which the signal RX is input, and input line section connected to this, a resonator section 22 for extracting only signals of intended frequency bands from among signals RX applied to this input line section 1 and an output line section 24 for transmitting the extracted signals.

In the embodiment based on the first aspect, each of the resonators 23-1, 23-2, 23-3, 23-4, 23-5, 23-6, 23-7, 23-8 and 23-9 is a λ/2 resonator. Current density reduction parts 31-1, 31-2, 31-3, 31-4, 31-5, 31-6, 31-7, 31-8 and 31-9 are formed at the center portion and the vicinity thereof along the length direction of the line pattern 25 thereof.

Each λ/2 resonator (each of 23-1, 23-2, 23-3, 23-4, 23-5, 23-6, 23-7, 23-8 and 23-9) is similar to the form shown in FIG. 14. It is bent in half at the center portion thereof and the length of each side is λ/4. The current is concentrated at this bent portion where the maximum current density is exhibited. On the other hand, each end portion of each λ/2 resonator is open, and the current becomes almost zero.

Therefore, each of the current density reduction parts (31-1, 31-2, 31-3, 31-4, 31-5, 31-6, 31-7, 31-8 and 31-9) is formed at the bent portion, that is, the center portion and the vicinity thereof of the λ/2 resonator.

Various methods of reducing the current density can be considered. In the embodiment shown in FIG. 2, the line width of the line pattern 25 at the center portion and the vicinity thereof is made broader than the line width of the portions other than this to form the current density reduction part 31 (indicated as 31 as representative of 31-1, 31-2, 31-3, 31-4, 31-5, 31-6, 31-7, 31-8 and 31-9).

At the broadening of the line width, it is possible to form a triangular shape or square shape or heart shape at the current density reduction part 31. In the embodiment shown in FIG. 2, however, the current density reduction part 31 is formed to exhibit a circular shape as a whole. By imparting the circular shape, the corners which are always formed in the case of a triangular shape etc. can be eliminated. This is because, if there is a corner in the microstrip line, the already explained edge effect appears there, and the superconducting characteristic is apt to be lost.

Note that, a concrete example of the superconducting filter 14 shown in FIG. 2 will be explained in further detail as follows.

First, a high-temperature superconducting thin film made of YBCO (Y-Ba-Cu-O) is coated over a substrate 26 having a thickness of 0.5 mm, made of magnesium oxide (MgO) and having a dielectric constant $\in$=9.7. Next, microstrip line patterns having the line patterns 25 shown in FIG. 2 are formed by photolithography. At this time, when the characteristic impedance is set to 50 Ω, the line width w of each resonator 23 (indicated by 23 as representative of 23-1, 23-2, 23-3, 23-4, 23-5, 23-6, 23-7, 23-8 and 23-9) is 0.5 mm. Also, the radius of the circular density reduction part 31 is set to 2.0 mm. Note that, in FIG. 2 (same also in FIG. 14), the adjoining resonators 23 are alternatively rotated by 180°, but it is not always necessary to do this in principle. For example, all resonators 23-1, 23-2, 23-3, 23-4, 23-5, 23-6, 23-7, 23-8 and 23-9 may be oriented in the same direction.

In the case of the present invention, however, the adjoining resonators 23 are preferably alternately rotated by 180°. This is because if all resonators 23-1, 23-2, 23-3, 23-4, 23-5, 23-6, 23-7, 23-8 and 23-9 are oriented in the same direction, the adjoining current density reduction parts 31 become considerably close to each other, so a deleterious interference occurs.

Thus, according to the superconducting filter 14 of FIG. 2, in each resonator 23, the current density at the so-called antinode part where the current becomes the maximum is greatly reduced, and the edge effect is suppressed. Accordingly, the power resistance is improved. In this case, there is no enlargement of size of the superconducting filter 14 due to the introduction of the current density reduction parts 31, where nine stages of resonators 23-1, 23-2, 23-3, 23-4, 23-5, 23-6, 23-7, 23-8 and 23-9) can be accommodated on a substrate 26 of about 5 cm length (left and right direction of FIG. 2) easily, like FIG. 14.

As already explained, in a filter for the super-high frequency bands, the provision of an additional part like the current density reduction part 31 changes the impedance of the resonator per se and the impedance between resonators. Therefore, usually, a person skilled in the art would expect that a superconducting filter having intended characteristics could no longer be obtained. However, the present applicant confirmed by using electromagnetic simulation that such a change or deterioration of characteristics was small. This will be explained.

Figure 3:
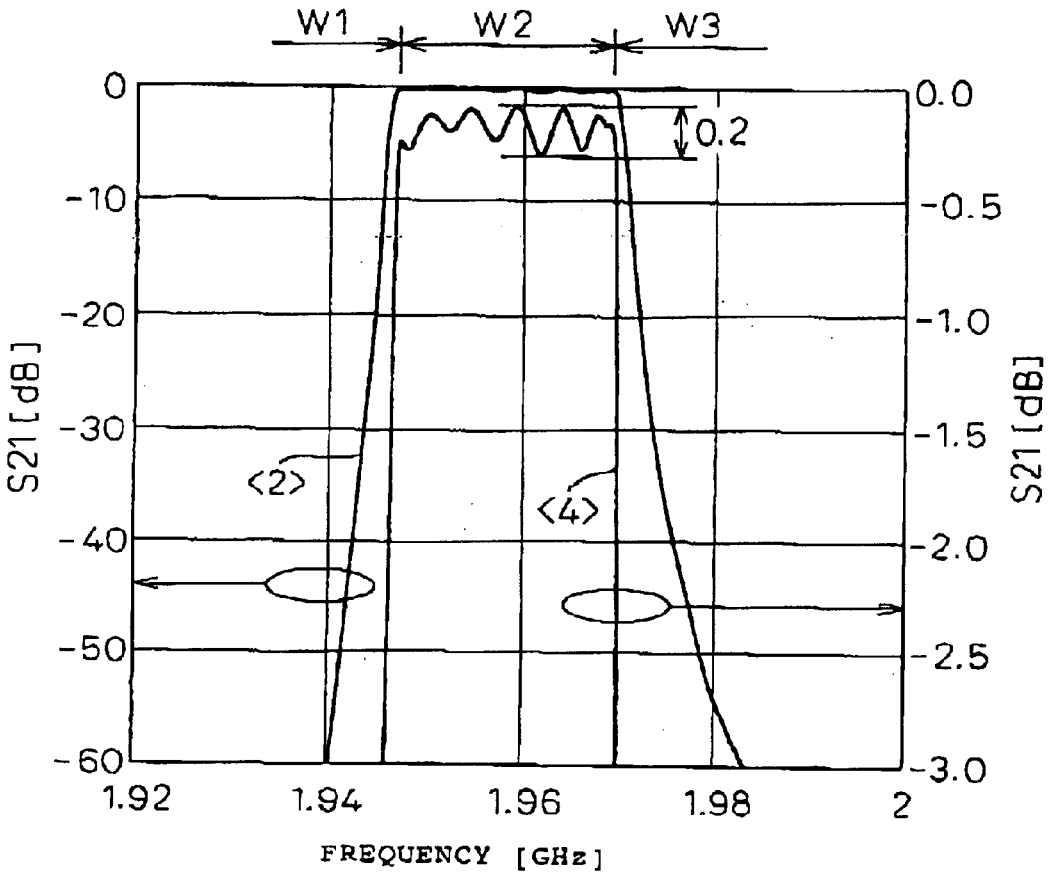
FIG. 3 is a view showing that filter characteristics do not deteriorate even if a current density reduction part according to the present invention is introduced.

FIG. 3 is a view showing that the filter characteristics do not deteriorate even if a current density reduction part according to the present invention is introduced.

In FIG. 3, the abscissa represents the frequency, and the left and right ordinates represent pass characteristics S21 and correspond to the graph of FIG. 16 explained above. W2 in the figure indicates the pass band, and W1 and W3 on the two ends thereof indicate cut zones.

The characteristic curve <2> shown in FIG. 3 is the characteristic curve obtained by the superconducting filter 14 according to the present invention shown in FIG. 2. On the other hand, the characteristic curve <4> of FIG. 3 is the characteristic curve showing the enlarged ordinate of the characteristic curve <2>. Accordingly, the ordinate of the characteristic curve <2> is indicated on left side of FIG. 3 and the ordinate of the characteristic curve <4> is indicated on the right side of the figure.

At the time of design of the superconducting filter 14 described above, the ripple value, set as the initial value, is 0.01 dB. When performing the simulation under this design condition, the ripple exhibited a value of 0.2 dB at the maximum as shown in FIG. 3.

In this way, a ripple value of 0.2 dB or less is the practical value. This shows that steep attenuation characteristics were ensured. Incidentally, a value of ripple up to about 2 to 3 dB is thought to be a practical value (a value more than 2 to 3 dB means a defective filter), so the value (0.2 dB or less) is kept smaller than this (2 to 3 dB) by one order. In this way, the value of the ripple slightly deteriorates to an extent where no problem occurs in practical use, but the effect that the power resistance can be greatly improved is much greater than the deterioration.

Additionally explaining this ripple, when designing a small number of stages of resonators 23, the smaller the ripple, the gentler the attenuation characteristics in the pass bands (refer to the characteristic curve <1> of FIG. 16). In FIG. 2, the number of stages of resonators 23 is set to as large as nine in the design, so there is no large influence exerted upon the attenuation characteristics even if the ripple is made small.

Figure 4:
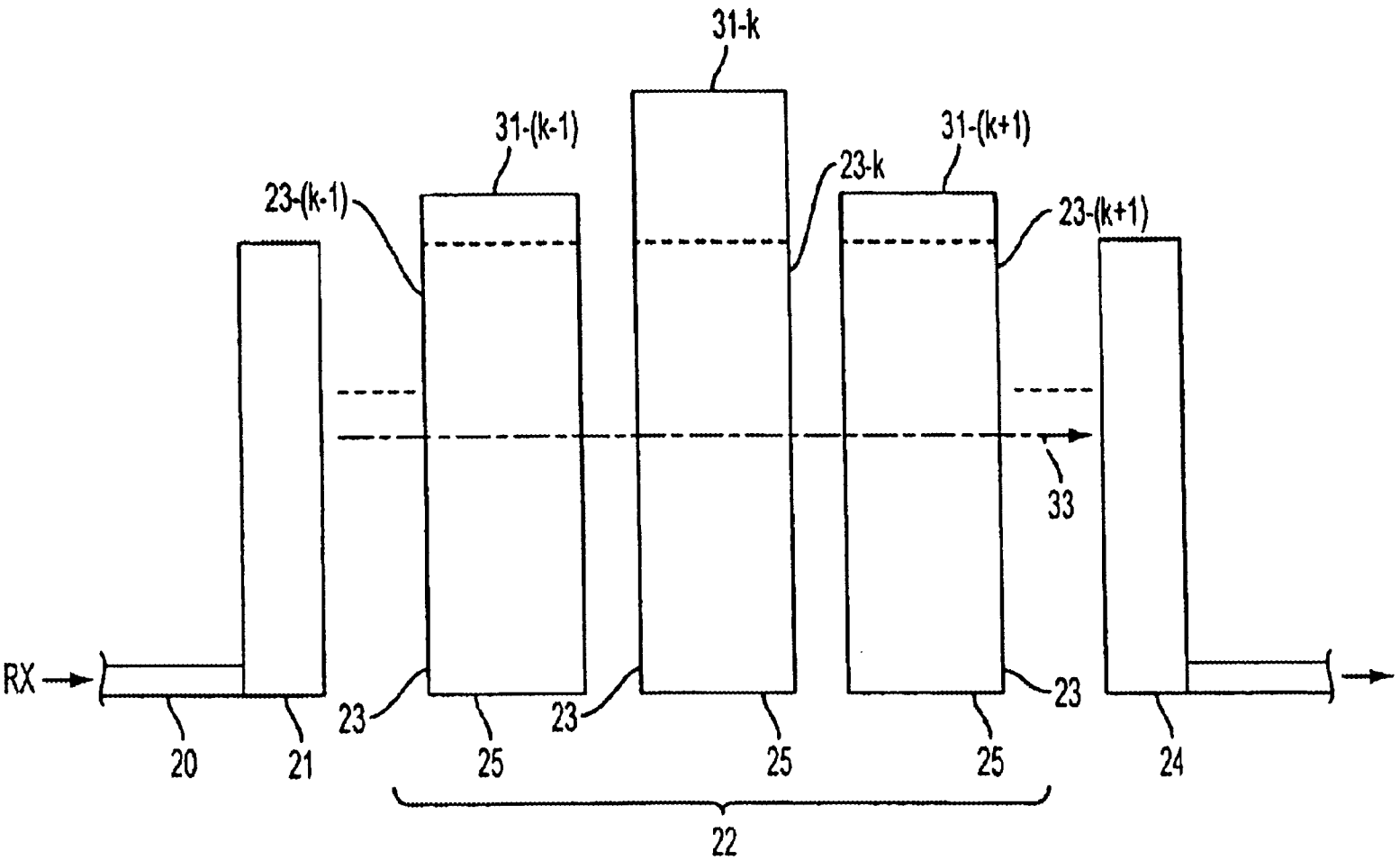
FIG. 4 is a view of the basic configuration of a superconducting filter based on a second aspect according to the present invention.

FIG. 4 is a view of the basic configuration of a superconducting filter based on the second aspect according to the present invention.

According to this basic configuration, there is provided a superconducting microstrip filter having a resonator section 22 including a plurality of resonators 23 cascaded in a line along a propagation path 33 of signals RX to be filtered, wherein at least resonators (23-($k$−1), 23-$k$, 23-($k$+1)) cascaded at the center portion and in the vicinity thereof of the propagation path 33 form current density reduction parts (31-($k$−1), 31-$k$, 31-($k$+1)) at parts of the line patterns 25 thereof and the resonators 23 nearer the center portion form current density reduction parts 31 becomes larger. Note that, when the number of stages of the resonators 23 forming the resonator section 22 is set to nine stages as explained above, k of 23-$k$ at the center thereof is equal to 5.

In the above first aspect, easing of the current concentration at the center portion was explained for each individual resonator 23. This time, however, when viewing the entire resonator section 22 as one resonator, in the pass band, the current becomes more easily concentrated at the resonators cascaded nearer the center portion. The second aspect (FIG. 4) pays attention to this point. The shape of the current density reduction part 31 is made larger in the resonators cascaded nearer the center portion (23-($k$−1)→23-$k$←23-($k$+1)). When the section is comprised of nine stages of resonators, the current density reduction part 31-$k$ (k=5) given to the resonator 23-$k$ (k−5) becomes the largest.

Figure 5:
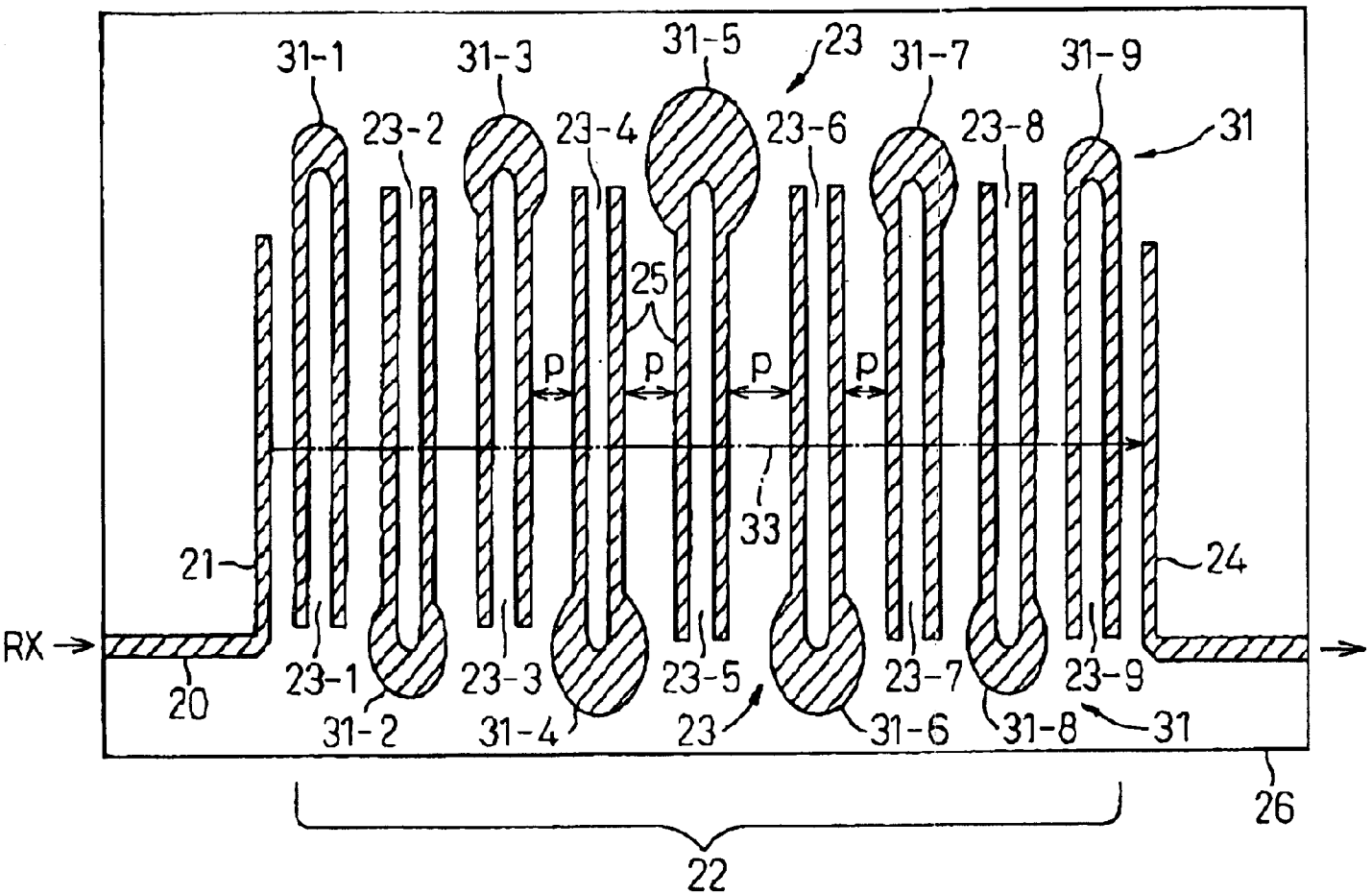
FIG. 5 is a plan view of an embodiment based on the second aspect.

FIG. 5 is a plan view of an embodiment based on the second aspect. The basic form is similar to the form of FIG. 14. In the string of resonators 23-1→23-2→23-3→23-4, the current density reduction parts become larger in the sequence of 31-1→31-2→31-3→31-4. Similarly, in the string of resonators 23-9→23-8→23-7→23-6, the current density reduction parts become larger in the sequence of 31-9→31-8→31-7→31-6. The current density reduction part 31-5 given to the resonator 23-5 at the center portion becomes the largest. In this case, the pitch p between adjacent resonators is made larger toward the center portion, while the pitch between adjacent resonators, at the input side and output side, maintains the pitch of the resonator section 22 in the configuration shown in FIG. 14. By this, the size of the overall superconducting filter 14 is made as small as possible. Note that, in FIG. 5, the configuration is the same as the case of the already explained first aspect in the following items:

(i) The resonators 23 are λ/2 resonators. The current density reduction parts 31 are formed along the length direction of the line patterns 25 thereof at the center portions and in the vicinities thereof, (ii) The current density reduction parts 31 are formed by mating the line width of the line patterns 25 at the center portions and in the vicinities thereof broader than the line width of the other portions, and (iii) The current density reduction parts 31 exhibit circular shapes as a whole.

Figure 6:
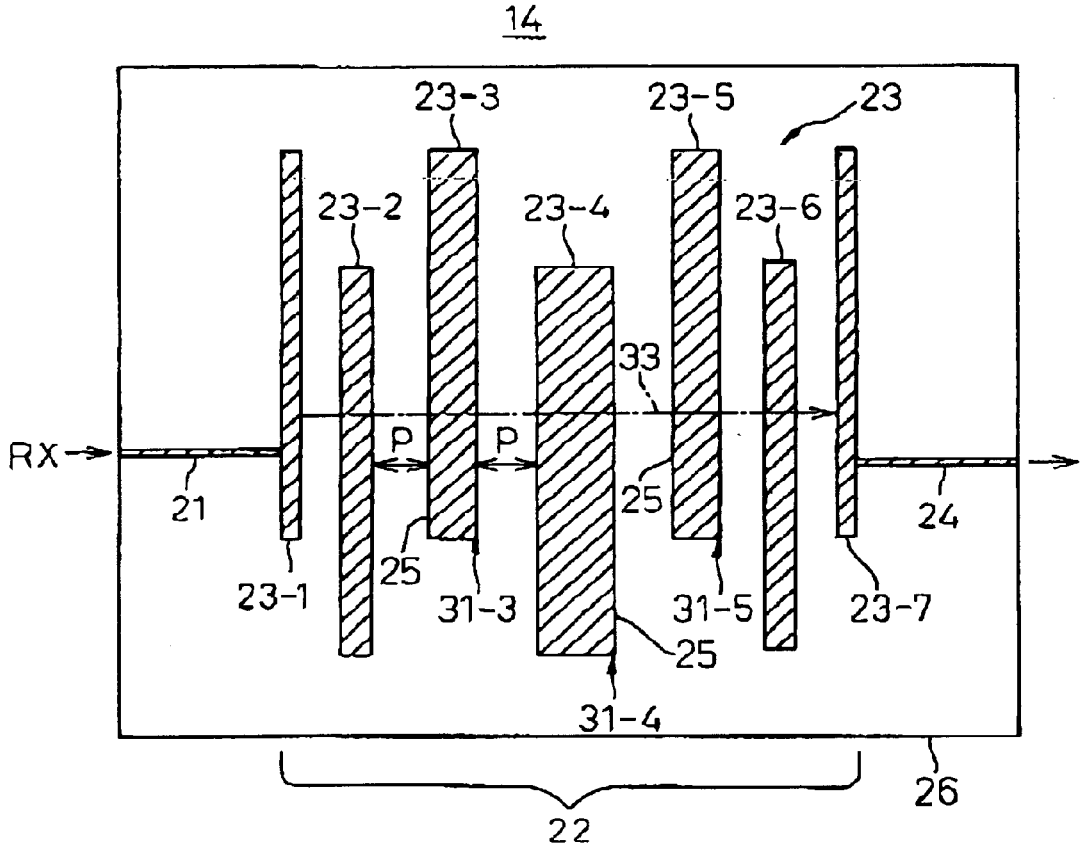
FIG. 6 is a plan view of an embodiment based on a third aspect of the present invention.

FIG. 6 is a plan view of an embodiment based on a third aspect of the present invention.

The basic form of the third aspect is similar to the form of FIG. 17, but the thinking of the above second form is further introduced into this form of FIG. 17.

Namely, according to the third aspect, there is provided a superconducting microstrip filter 14 having a resonator section 22 including a plurality of resonators 23 cascaded in a line along the propagation path 33 of signals RX to be filtered, wherein at least resonators cascaded at the center portion and in the vicinity thereof of the propagation path 33 form current density reduction parts 31 over the entire length of the line patterns 25 thereof and the resonators nearer the center portion form the current density reduction parts 31 become larger.

More concretely, in the configuration of FIG. 6, the current density reduction parts 31 are formed by gradually making the line width of the line pattern 25 broader in the resonators nearer the center portion.

In the example shown in FIG. 6, in a superconducting filter 14 having seven stages of resonators 23-1, 23-2, 23-3, 23-4, 23-5, 23-6 and 23-7, the current density reduction part 31-4 given to the center resonator 23-4 is the largest. Namely, the line width of the line pattern 25 forming the resonator 23-4 is the broadest, while the line width becomes successively thinner as one moves from resonator 23-4 to each of resonators 23-3, 23-2 and 23-1. Similarly, the line width becomes successively thinner as one moves from resonator 23-4 to each of resonators 23-5, 23-6 and 23-7. When compared with the configuration of FIG. 17, only the resonator at the center portion becomes a resonator having a thick line width, so the entire superconducting filter 14 does not become so large.

Note that the pitch p between adjoining resonators similarly becomes larger toward the center portion.

Above, a filter for reception waves was explained, so a filter for transmission waves will be explained below. These filter for reception waves and filter for transmission waves are not separate and independent. In actuality, preferably one superconducting filter is formed combining the configuration of the filter for reception waves explained above and the configuration of the filter for transmission waves as will be explained from now on. This is because the filter for reception waves provided in the base station according to the above example is simultaneously strongly affected by its own wraparound transmission power and the transmission power from other adjacent antennas of the base station as well, so must also combine the function of a filter for transmission waves.

Before explaining the embodiment of a filter for transmission waves, a general problem concerning the filter for transmission waves will be explained.

As clear also from FIG. 13 explained above, the transmission power from the transmitter apparatus 13 side usually reaches tens to hundreds of watts. Most of the power is radiated from the antenna 11 to the cell or sector. However, part of the power is wrapped around to the receiver apparatus 12 side. Also, when the transmitter apparatus 13 and receiver apparatus 12 of FIG. 13 are provided in the above base station, a strong transmission power radiated from the antenna other than the illustrated antenna 11 among the antennas provided in the base station flows to the receiver apparatus 12 side through the antenna 11.

When the base station is used in for example a W-CDMA system, the reception frequency band and transmission frequency band of the base station are for example 1960 to 1980 MHz and 2150 to 2170 MHz. In this case, signals of undesired transmission frequency bands are eliminated without a problem when using a general filter using ordinary metal. When using a superconducting filter, however, the following problem occurs.

Namely, referring to FIG. 14, the transmission frequency bands (2150 to 2170 MHz) are sufficiently separate from the reception frequency bands (1960 to 1980 MHz). Therefore, when the transmission power is wrapped around into the superconducting filter 14, the current is liable to concentrate at the input line section 21 thereof and be reflected there. However, as it approaches the critical current density ($J_c$), the superconducting state starts break down, and the filter characteristic of the superconducting filter 14 deteriorates. That is, when high transmission power out of the band flows into the superconducting filter 14, the problem arises that only the input line section 21 becomes unable to keep the superconducting state.

That problem will be further clarified experimentally.

Figure 7:
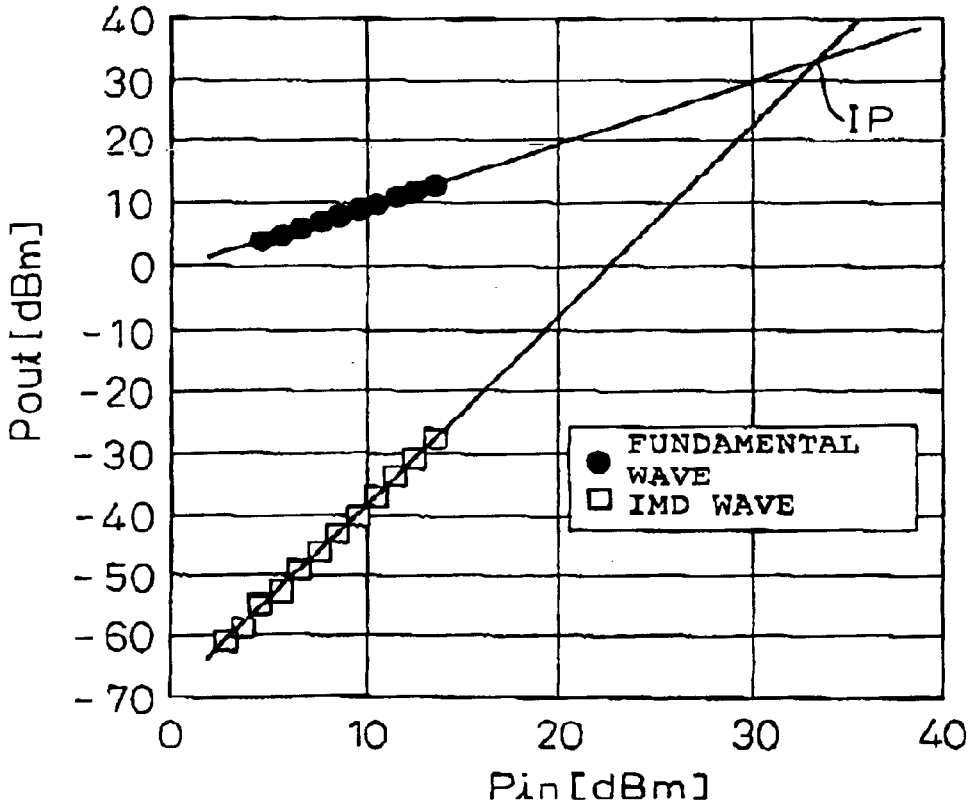
FIG. 7 is a graph of a third-order inter-modulation distortion (IMD) characteristic of a superconducting filter.

In a superconductor, a distortion wave is produced due to its own nonlinearity. For example, when assuming that two waves having frequencies slightly different from each other are input to the pass band of the superconducting filter 14, a so-called third-order inter modulated distortion wave (third-order IMD wave) is produced. FIG. 7 is a graph of the third-order IMD characteristic of a superconducting filter.

In FIG. 7, Pin and Pout are the input power and the output power of the superconducting filter 14. Note that, if the frequencies of the fundamental waves are $\omega 1$ and $\omega 2$, the third-order IMD waves are $2\omega 2-\omega 1$ and $2\omega 1-\omega 2$.

This graph of FIG. 7 shows the situation of a change of a third-order IMD wave which rises with an inclination of three times the fundamental waves when two waves ($\omega$1, $\omega$2) separated from each other by 1 MHz are input to the pass band of a YBCO superconducting microstrip hair pin type filter (referred to as specimen 1) having the microstrip pattern shape of FIG. 14 and having C-axis oriented YBCO thin films formed on both surfaces of the substrate 26. It is seen from this graph that an intercept point IF at which the fundamental waves and the third-order IMD wave coincide has a value of 33 dBm.

Also, when the transmission power is input to the superconducting filter 14 of the specimen 1, the third-order IMD becomes further larger.

Figure 8:
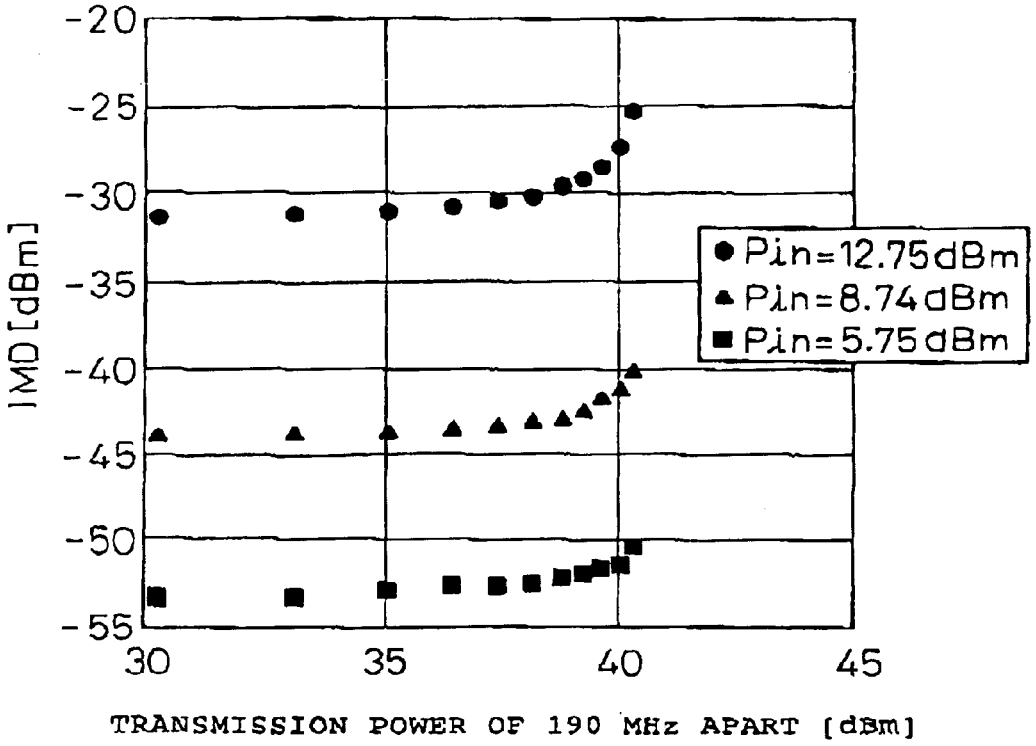
FIG. 8 is a graph of a third-order IMD deterioration characteristic of the superconducting filter.

FIG. 8 is a graph of the third-order IMD deterioration characteristic of the superconducting filter. TWO waves (the input powers are three types of Pin=12.75 dBm, 8.74 dBm, and 5.75 dBm) separate from each other by 1 MHz are input to the pass band of the superconducting filter 14, and the third-order IMD is produced. Further, it is shown in this FIG. 8 how the third-order IMD become large in a case where the transmission wave of a band separate from the center frequency by 190 MHz is assumed, and the power of this band is input to the superconducting filter 14 of the specimen 1 while gradually enlarging the power of this band.

In this way, it is understood that the third-order IMD abruptly increases as the transmission power is raised.

Figure 9:
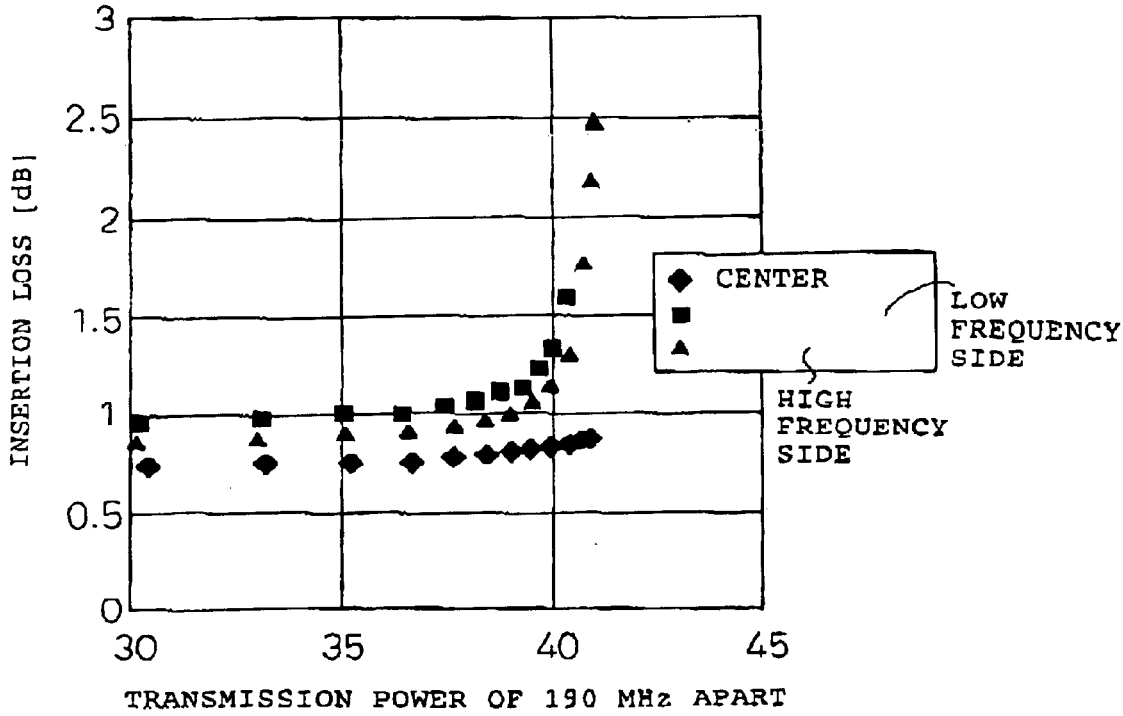
FIG. 9 is a graph of insertion loss characteristics of the superconducting filter.

FIG. 9 is a graph of the insertion loss characteristic of the superconducting filter.

This is a graph showing how the insertion loss in the pass band of the superconducting filter 14 of FIG. 14 (near the center, low frequency band end, high frequency band end) deteriorates due to the increase of the transmission power.

It is seen also from this FIG. 9 that the insertion loss abruptly increases along with an increase of the transmission power.

With the background explained above, an explanation will be made of a fourth aspect and fifth aspect of the present invention (filter for transmission waves).

Figure 10:
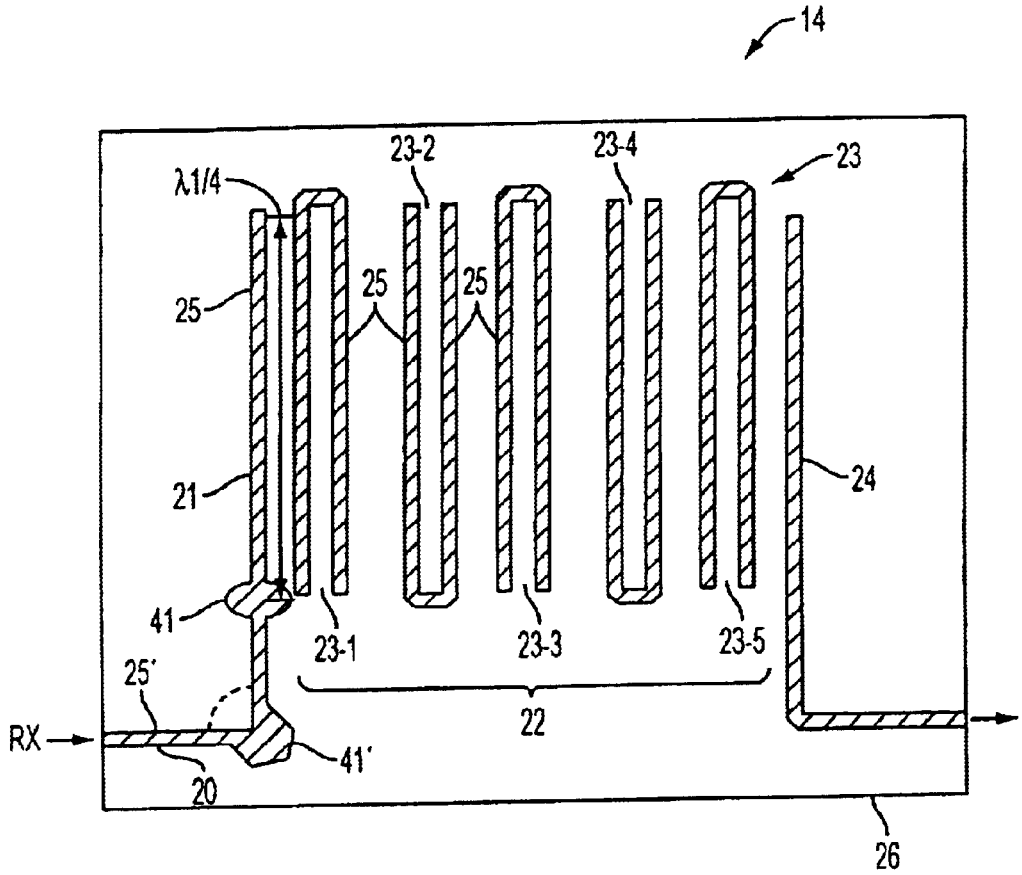
FIG. 10 is a view of an example of the configuration of a superconducting filter based on a fourth aspect according to the present invention.

FIG. 10 is a view of an example of the configuration of a superconducting filter based on the fourth aspect according to the present invention.

In this fourth aspect, there is provided a superconducting microstrip filter 14 having an input line section 21 to which signals RX to be filtered are input and a resonator section 22 arranged adjoining this input line section 21 and including at least one resonator 23, wherein that input line section 21 forms a current density reduction part 41 (41') in one part of its line pattern 25.

The current caused by the transmission power flowing into the filter as the signal RX concentrates at the input line section 21. Then, that current concentrates at the portion of $\lambda'/4$ ($\lambda'$ is the wavelength of the related transmission wave) from the open end (upper end portion of the line pattern in the figure) of the input line section 21, whereupon the current density becomes the maximum. Accordingly, the current density reduction part 41 is formed in this portion of $\lambda'/4$ to keep the density to not more than $J_c$ and prevent breakdown of the superconducting state due to the transmission power.

In this case, the line width of the line pattern of the portion ($\lambda'/4$) where the current concentration becomes the maximum in the line pattern 25 of the input line section 21 is made broader than the line width of the portions other than this to form the current density reduction part 41.

In this fourth aspect, another current density reduction part 41' can be included.

Namely, when the line pattern 25 of the input line section 21 and the line pattern 25' of the input conductor 20 to which the signal RX is input are coupled in almost an L-shape, the line width of these line patterns in the coupling portion is made broader than the line width of the portions other than this to form the current density reduction part 41'.

The superconducting filter 14 is usually accommodated in a housing (not illustrated) accommodating this and connected to an external conductor (not illustrated) via a connector (not illustrated). This connector is usually arranged on the left side (on the side of the left side of the substrate 26) in FIG. 10. For this reason, the end portion opposite to the open end of the input line section 21 is bent to the side of the left side of the substrate 26 at substantially a right angle. In actuality, for the input line section 21, the input conductor 20 is coupled from a direction perpendicular to this.

This being so, the already explained edge effect may appear at this coupling portion. Another current density reduction part 41' eases the current density at that portion so that this edge effect does not conspicuously appear.

Both of the current density reduction parts 41 and 41' desirably exhibit circular shapes as a whole similar to the current density reduction part 31 explained above. Note that, in FIG. 10, the example where another current density reduction part 41' is projects out to the exterior angle side of the coupling portion is shown, but it is also possible, contrary to this, to project this to the interior angle side circularly (indicated by the dotted line in the figure).

Note that at least one of the above explained two current density reduction parts 41 and 41' is formed. In practical use, desirably both of these two reduction parts 41 and 41' are formed.

Finally, an explanation will be made of a fifth aspect of the present invention.

Figure 11:
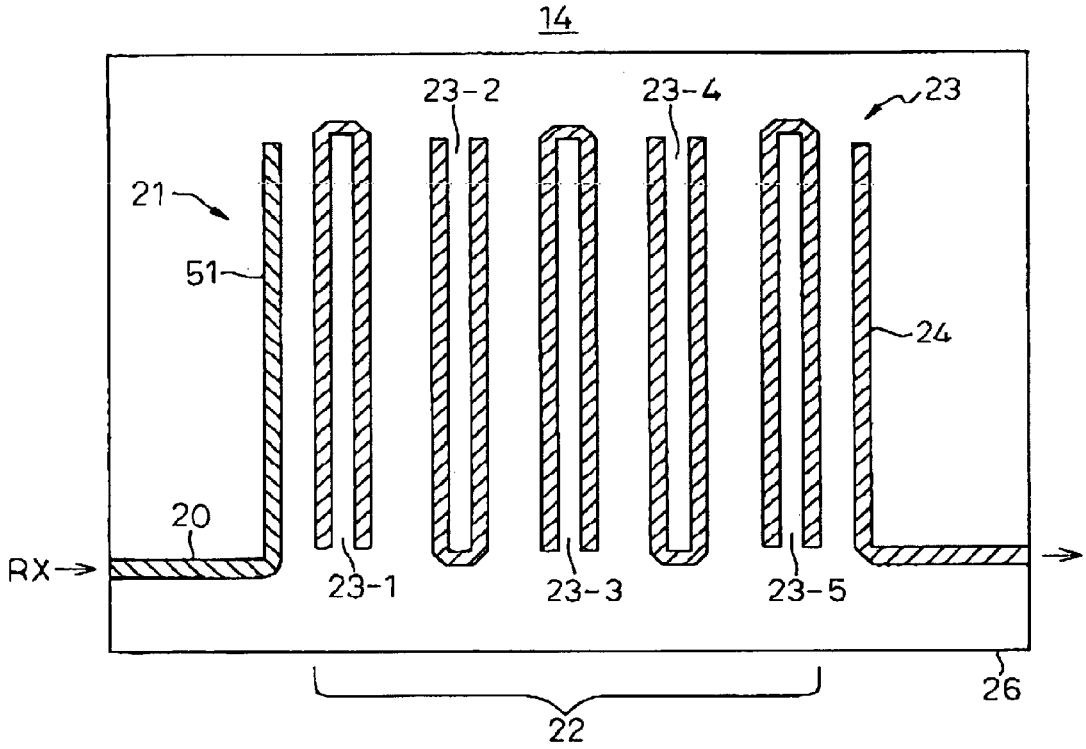
FIG. 11 is a view of an example of the configuration of a superconducting filter based on a fifth aspect according to the present invention.

FIG. 11 is a view of an example of the configuration of a superconducting filter based on the fifth aspect according to the present invention.

In this fifth aspect, there is provided a superconducting microstrip filter 14 having an input line section 21 to which signals RX to be filtered are input and a resonator section 22 arranged adjoining this input line section 21 and including at least one resonator 23, wherein only that input line section 21 is formed by a line pattern 51 made of a material other than a superconducting material.

Here, the above material other than a superconducting material is preferably a normal conducting material.

The power of the transmission power flowing into the filter from the outside concentrates at the input line section 21 as explained above. Therefore, in the fourth aspect, the current density reduction part 41 and/or 41' was provided in part of the input line section 21 to ease the current density. On the other hand, in the fifth aspect, as described above, an effect of reduction of the current density was obtained relatively not by directly reducing the current density, but by increasing the permissible current density at the input line section 21.

For this reason, concretely, the input line section 21 is comprised of a material other than a superconducting material. In practice, the input line section 21 is comprised of a normal conducting material. In this case, the introduction of the normal conducting material must not cause a remarkable increase of insertion loss at the superconducting filter 14. This will be explained later.

Below, a further detailed explanation will be given of the fifth aspect.

Referring to FIG. 11, when a transmission wave sufficiently apart from the reception frequency band flows into the superconducting filter 14, the transmission wave is apt to be reflected at the input line section 21. At this time, the current by that transmission wave concentrates at the input line section 21, but the input line section 21 is a line pattern 51 made of a metal of a normal conducting material, and something like superconduction breakdown will not occur. Accordingly, the characteristics of the superconducting filter 14 do not deteriorate.

Also, by forming the input line section 21 by a metal of a non-superconducting material, in comparison with the case where all of the superconducting filter is fabricated by a superconductor, increase of the insertion loss cannot be avoided. However, when a good electrical conductor such as gold, silver, copper, or aluminum is used as the pattern 51, the insertion loss thereof increases by only several tenths of a dB, and the original performance of the superconducting filter 14 is sufficiently maintained.

Further, by forming the line pattern 51 by a normal conducting material, the type of the normal conductor can be selected from a wide range. For this reason, the degree of freedom increases in the selection of solder materials and electrode materials for electrically connecting it to the connector for input explained above. If for example copper is used as the normal conductor, it becomes possible to use Pb—Sn-based ordinary solder.

In the embodiment of the fifth aspect based on the present invention, a substrate 26 having a thickness of 0.5 mm and made of magnesium oxide (MgO) (dielectric constant $\in_r$=9.7) is formed over it with resonators 23 and an output line section 24 by a high-temperature superconducting thin film and is formed over it with an input line section 21 by a copper thin film as the normal conductor.

For the frequency band, in for example the W-CDMA system, the reception frequency band and the transmission frequency band are for example 1960 to 1980 MHz and 2150 to 2170 MHz. Therefore, when the transmission wave flows into the superconducting filter 14, components of this transmission wave concentrate at the input line section 21 of the copper thin film and are sufficiently reflected there. Therefore something like superconduction breakdown can not occur.

Figure 12:
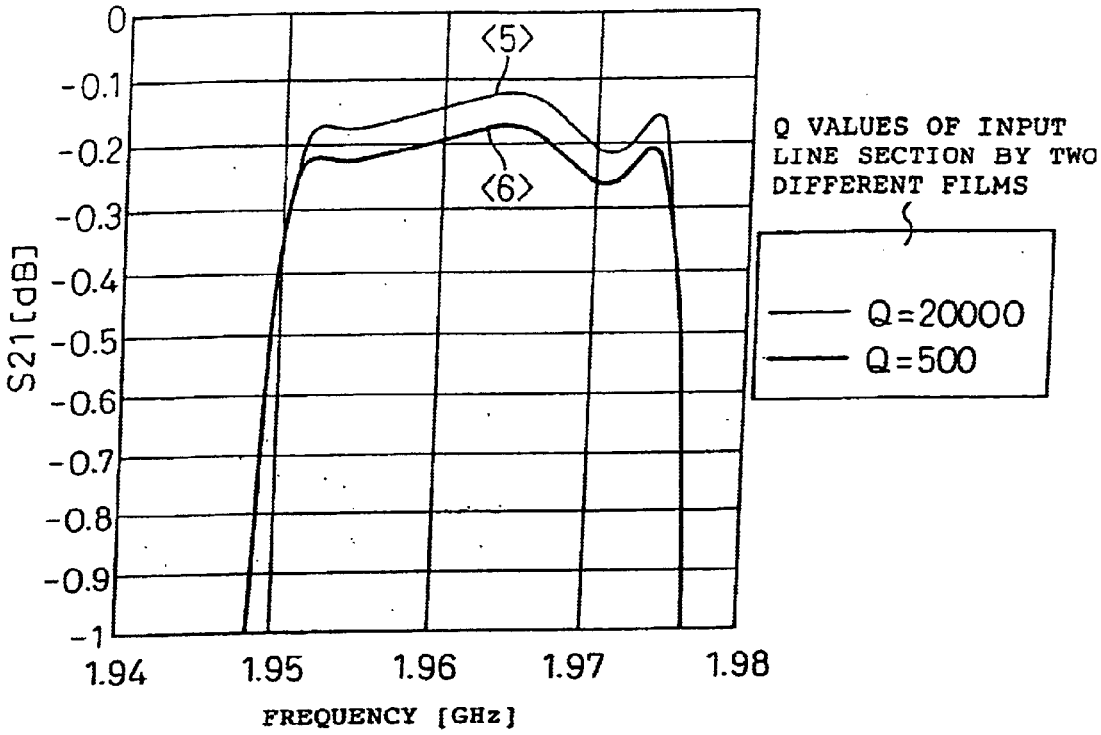
FIG. 12 is a graph showing that a large loss is not caused even if a normal conducting material according to the present invention are introduced into an input line section.

FIG. 12 is a graph showing that a large insertion loss is not caused even if a normal conductor according to the present invention is introduced into the input line section.

In the figure, the abscissa indicates the frequency, and the ordinate indicates the pass characteristic.

The results of frequency characteristic simulation by a hair pin type superconducting filter 14 having the pattern shape shown in FIG. 11 and having a center frequency of 1.962 GHz, a band width of 23 MHz, and five stages of resonators 23, designed using electromagnetic field simulation, and in a case where the input line section 21 was formed by a superconductor (Q value by film was 20000) and in a case where the input line section 21 was formed by a normal conductor (Q value by film was 500) are shown in FIG. 12 as characteristics <5> and <6> respectively. At this time, the resonator section 22 and the output line section 24 were formed by superconductors (Q value by film was 20000).

When the input line section 21 was formed by a superconductor, the insertion loss was 0.12 dB, but even if the input line section 21 is formed by a normal conductor, the insertion loss becomes 0.18 dB and the increase of the insertion loss is very small. Accordingly, it is understood that the performance as the superconducting filter 14 is sufficiently maintained irrespective of the introduction of the normal conductor (51).

Note that, in FIG. 10 and FIG. 11 used for the explanation of the fourth and fifth aspects, as the resonator section 22, a resonator section comprised of resonators having patterns similar to that shown in FIG. 14 but having a decreased number of stages was shown for simplification, but in practice, either of the first, second, and third aspects (FIG. 2, FIG. 5, FIG. 6) is desirably employed as this resonator section 22.

As explained above, according to the present invention, a superconducting filter capable of greatly improving the power resistance while maintaining the steep cut characteristics without enlarging the overall size is realized. Also, the superconducting filter based on the present invention can be used as a filter for reception waves, as a filter for transmission waves, or both.

What is claimed is:

1. A superconducting microstrip filter having a resonator section including a plurality of resonators cascaded in a line along a propagation path of signals to be filtered, each of the resonators comprising a microstrip hair pin resonator configured as a $\lambda/2$ resonator, said plurality of resonators being constructed so that adjoining ones of the plurality of resonators are alternately rotated by 180°, wherein each of said plurality of resonators includes a current density reduction part at a center portion along a length direction of a line pattern thereof, said center portion of the respective line pattern being broader in line width that than the remainder of the line pattern thereof.

2. A superconducting microstrip filter as set forth in claim 1, wherein said current density reduction part exhibits a circular shape.

3. A superconducting microstrip filter having an input line section to which signals to be filtered are input and having a resonator section comprising a superconducting material and arranged adjoining the input line section and including a plurality of resonators cascaded in a line along a propagation path of signals to be filtered, each of the resonators comprising a microstrip hair pin resonator configured as a $\omega/2$ resonator, said plurality of resonators being constructed so that adjoining ones of the plurality of resonators are alternately rotated by 180°, wherein only said input line section has a line pattern comprising a non-superconducting material being able to increase the permissible current density relative to that of said superconducting material.

4. A superconducting microstrip filter as set forth in claim 3, wherein said non-superconducting material is a conducting material.

5. A superconducting microstrip filter having a resonator section including a plurality of resonators cascaded in a line along a propagation path of signals to be filtered, each of the plurality of resonators having respective line patterns and comprising a microstrip hair pin resonator configured as a $\lambda/2$ resonator, said plurality of resonators being constructed so that adjoining ones of the plurality of resonators are alternately rotated by 180°, wherein three or more of said plurality of resonators cascaded at a middle cart of said propagation path and in the vicinity thereof include current density reduction parts at center portions of the line patterns thereof;

said current density reduction parts being larger in size in said resonators located nearer to said middle part.

6. A superconducting microstrip filter having a resonator section including a plurality of resonators cascaded in a line along a propagation path of signals to be filtered, each of the plurality of resonators having respective line patterns, wherein three or more of said plurality of resonators cascaded at a middle part of said propagation path and in the vicinity thereof include current density reduction parts over the entire length of the line patterns thereof;

said current density reduction parts having line widths of said line patterns that are broadest at the center of said middle part and that that become narrower in successive ones of said plurality of resonators, moving away from said middle part.

7. A superconducting microstrip filter as set forth in claim 6, wherein a respective pitch p between adjoining resonators becomes larger moving along said propagation path of signals toward said middle part.

8. A superconducting microstrip filter having an input line section to which signals to be filtered are input and having a resonator section arranged adjoining the input line section and including at least one resonator, wherein said input line section comprises a current density reduction part in one part of a line pattern of the input line section and said current density reduction part has a line width at a portion of the line pattern of the respective line that is broader than the line width at other portions of said line pattern of the respective line, and a current concentration is at a maximum in the broader portion of the line pattern of the respective line.

9. A superconducting microstrip filter as set forth in claim 8, wherein said input line section and an input conductor to which said signal is input are coupled in substantially an L-shape, and a further current density reduction part is disposed at the coupling portion and has a line width broader than the line width of portions of the input line section and the input conductor other than this the coupling portion.

10. A superconducting microstrip filter as set forth in claim 9, wherein said current density reduction part exhibits a circular shape.

* * * * *